United States Patent [19]

Torii

[11] Patent Number: 4,997,806

[45] Date of Patent: Mar. 5, 1991

[54] THERMOSENSITIVE RECORDING MATERIALS

[75] Inventor: Takahiro Torii, Takasago, Japan

[73] Assignee: Mitsubishi Paper Mills, Ltd., Tokyo, Japan

[21] Appl. No.: 323,899

[22] Filed: Mar. 15, 1989

[30] Foreign Application Priority Data

Jun. 24, 1988 [JP] Japan ..... 63-157423

[51] Int. Cl.[5] ..... B41M 5/18

[52] U.S. Cl. ..... 503/226; 427/152; 503/200

[58] Field of Search ..... 503/200, 207, 226; 427/150-152

[56] References Cited

U.S. PATENT DOCUMENTS 4,168,845 1/1978 Oeda et al. ..... 430/964

FOREIGN PATENT DOCUMENTS 2800485 of 0000 Fed. Rep. of Germany ..... 503/226
3700299 of 0000 Fed. Rep. of Germany ..... 503/226
1242872 10/1986 Japan ..... 503/226

*Primary Examiner*—Pamela H. Schwartz
*Attorney, Agent, or Firm*—Cushman, Darby & Cushman

[57] ABSTRACT

By providing an intermediate layer composed of colloidal silica and/or alumina between a support and a thermosensitive color forming layer, a thermosensitive recording material having high color sensitivity which is free from undesirable foreign matters adhered to a thermal head can be provided. The colloidal silica and/or colloidal alumina is used in a coverage of 1 to 15 g/m$^2$.

4 Claims, No Drawings

THERMOSENSITIVE RECORDING MATERIALS

BACKGROUND OF THE INVENTION

1. Field of the Invention

The present invention relates to thermosensitive recording materials comprising a support containing a substantially colorless or light-colored electron donative leuco dye and a color developer of an electron accepting substance color.

2. Discussion on Related Arts

Thermosensitive recording materials are generally composed of a support such as paper, synthetic paper, a plastic film, etc. having provided thereon a thermosensitive color forming layer containing mainly a composition capable of forming a color with heat, in which colored images are obtained by heating with a thermal head, a thermal pen, a laser light, a strobo flush, etc. This type of recording material has such advantages that recording can be made using a relatively simple equipment in a short period of time without such complicated processings as development, fixing, etc. compared to other recording materials, causing noise and environmental pollution is less, its cost is relatively low and the like. Thus, these materials have been widely used as recording materials in various areas including electronic computers, facsimile machines, ticket vending machines, labellers, recorders, etc., in addition to making copies of books, documents, etc.

Thermosensitive recording materials are generally prepared by separately grinding colorless or light-colored leuco dyes of lactone, lactam or spiropyrane type as a color former and a color developer capable of forming a color by heating the color former, for example, a phenolic substance, an organic or inorganic acidic substance or its ester or salt, etc. with a ball mill or an attritor and the like into an optional particle size, adding a binder to the ground particles, mixing them, if necessary and desired, further incorporating pigments and additives into the mixture and then applying the resulting mixture onto a support, for example, paper, by means of coating with an air knife coater, etc. and drying.

In order to improve color sensitivity further, smoothness of the surface of the thermosensitive color forming layer is enhanced via a machine calendering treatment or a supercalendering treatment, etc., after the application followed by drying described above, whereby close contact with a thermal head is achieved.

Furthermore, many proposals have been hitherto made to provide an intermediate layer between a support such as paper and a thermosensitive color forming layer, in order to attain super high sensitivity and at the same time, to minimize adherence of thermally fused matters onto the thermal head (hereafter referred to as foreign matters adhered to head).

As known substances for the intermediate layer or known intermediate layers heretofore proposed, there are, for example, an intermediate layer of synthetic paste, starch or gelatin described in Japanese Patent application KOKAI (Laid-Open) No. 48-10942; an intermediate layer containing calcium carbonate and inorganic powders showing oil absorption of 50 ml/100 g or more described in Japanese Patent application KOKAI (Laid-Open) No. 54-23545; an intermediate layer composed of finely divided particles of synthetic resin and a binder described in Japanese Patent application KOKAI (Laid-Open) No. 55-86789; an intermediate layer containing urea or thiourea derivatives described in Japanese Patent application KOKAI (Laid-Open) No. 59-184691; an intermediate layer composed of a filler, wax or a wax-like substance and a binder described in Japanese Patent application KOKAI (Laid-Open) No. 59-204594; an intermediate layer containing bisphenol derivatives described in Japanese Patent application KOKAI (Laid-Open) No. 60-122191; an intermediate layer using polystyrene and silicon oxide in combination described in Japanese Patent application KOKAI (Laid-Open) No. 61-89883; an intermediate layer containing either a 2,3-dihydroxynaphthalene compound or a metal compound described in Japanese Patent application KOKAI (Laid-Open) No. 61-164882; an intermediate layer containing the same color developer as used in the thermosensitive color forming layer described in Japanese Patent application KOKAI (Laid-Open) No. 61-274989; an intermediate layer containing a phenolic antioxidant described in Japanese Patent application KOKAI (Laid-Open) No. 62-39281; an intermediate layer containing 4,4'-bisphenolsulfone monoether compound described in Japanese Patent application KOKAI (Laid-Open) No. 62-149477; an intermediate layer containing a diphenolic antioxidant described in Japanese Patent application KOKAI (Laid-Open) No. 62-167076; an intermediate layer containing a benzotriazole compound described in Japanese Patent application KOKAI (Laid-Open) No. 62-176879; etc.

It is currently general to take so-called dual structure that these substances for the intermediate layer are coated onto a support in a coverage or coating amount of 1 to 15 g/m$^2$ (dry solid weight) depending upon purpose of use and providing thereon a thermosensitive color forming layer.

By taking the dual layer structure as described above, improvement in sensitivity, reduction in foreign matters adhered to head or improvement in storability of colored images are achieved but the issues of sensitivity and foreign matters adhered to head are yet unsatisfactory. For purposes of further improving smoothness thereby to improve close contact with a thermal head, large pressure is applied by supercalendering, etc. so that a color forming reaction undesirably occurs between a leuco dye and a color developer in a thermosensitive color forming layer to cause a color stain on thermosensitive paper, that is, background fog occurs.

To improve these problems, so-called three layer structure providing the first and second intermediate layers on a support and then the thermosensitive layer thereon has been proposed. There have been proposed, for example, a method of providing the first intermediate layer containing a foamable plastic filler and the second intermediate layer containing a filler and a binder in Japanese Patent application KOKAI (Laid-Open) No. 59-225987; a method of providing a film-forming polymer as the first intermediate layer and a composition mainly composed of a pigment showing an apparent specific gravity of 0.5 g/cm$^2$ or below as the second intermediate layer in Japanese Patent application KOKAI (Laid-Open) No. 61-11286; a method of providing an inorganic pigment having oil absorption of 100 ml/100 g or more as the first intermediate layer and a film-forming high molecular substance layer as the second intermediate layer in Japanese Patent application KOKAI (Laid-Open) No. 61-193880; a method of providing the first intermediate layer mainly composed of polyvinyl alcohol and the second intermediate layer mainly composed of finely divided hydrophobic high molecular particles in Japanese Patent application KOKAI (Laid-Open) No. 61-229589, etc.

According to replication by the present inventors, it was confirmed that some of these proposals achieved great improvement in sensitivity; however, it was observed that the foreign matter problem was rather accelerated.

SUMMARY OF THE INVENTION

An object of the present invention is to provide thermosensitive recording materials having improved sensitivity and having minimized foreign matters adhered to a thermal head.

That is, the present invention is based on the finding that by providing an intermediate layer containing colloidal silica and/or colloidal alumina between the surface of a support and a thermosensitive color forming layer, color sensitivity is improved and generation of foreign matters adhered to head is minimized and therefore, excellent thermosensitive recording materials can be obtained. The present invention has thus been accomplished.

The present invention is concerned with a thermosensitive recording material comprising a support having provided thereon a thermosensitive color forming layer comprising substantially colorless or light-colored electron donative leuco dye and an electron accepting color developer which reacts with the electron donative leuco dye to form a color, and further provided between the support and the thermosensitive color forming layer an intermediate layer comprising at least one of colloidal silica and colloidal alumina as the main component.

DETAILED DESCRIPTION OF THE PREFERRED EMBODIMENTS

Colloidal silica or colloidal alumina as used in the present invention refers to a colloid solution of anhydrous silicic acid or alumina hydrate having super fine particles of several millimicrons to several hundred millimicrons; the solution is prepared using water as a medium. The solution may also be a colloid solution containing both anhydrous silicic acid and alumina hydrate. A concentration of anhydrous silicic acid or alumina hydrate is generally approximately 10 to 30 (w/w)% in the colloid solution. When both anhydrous silicic acid and alumina hydrate are used, the concentration is also controlled within the range of approximately 10 to 30 (w/w)% in total. According to the present invention, the colloid solution described above is mixed with a binder or a white pigment and the resulting mixture is provided as the intermediate layer.

Examples of binders which are used in the present invention include water soluble high molecular substances such as polyvinyl alcohol, sodium polyacrylate, polyvinylpyrrolidone, polyethylene oxide, polyacrylamide, sodium alginate, gelatin, casein, etc.; starch and derivatives thereof, cellulose derivatives such as methoxycellulose, hydroxyethyl cellulose, carboxymethyl cellulose, methyl cellulose, ethyl cellulose, etc.; latex emulsions which are hydrophobic polymers such as polyvinyl acetate, polyurethane, styrene-butadiene copolymer, styrene-butadiene-acrylic copolymer, polyacryl, polyacrylates, etc.

Examples of the white pigment which can be used in the present invention include inorganic white pigments such as kaolin, calcined kaolin, natural silica, titanium oxide, clay, talc, calcium carbonate, calcium oxide, magnesium carbonate, magnesium oxide, magnesium hydroxide, etc.; organic white pigments such as synthetic silica, urea-formalin resin, styrene-methacrylic acid copolymer resin, polystyrene resin, etc. The white pigment is optionally chosen from these substances and provided for use.

To provide the intermediate layer of the present invention, there are a coating method using a size press, an air knife, a blade, a roll, etc., or a gravure coating method.

A ratio of the colloidal silica and/or colloidal alumina to the white pigment used in the intermediate layer of the present invention is generally in a range of 100:0 to 5:95, preferably, 100:0 to 10:90, in a weight ratio (part). When the ratio of the colloidal silica and/or colloidal alumina is less than 5 parts, the effects of improving sensitivity and reducing the foreign matters adhered to head are poor. A coating amount may be varied depending upon the rate of the colloidal silica and/or colloidal alumina to be used but preferably 1 to 15 g/m$^2$ in a dry solid weight.

The thermosensitive color forming layer provided on the intermediate layer of the present invention is composed of the leuco dye and the color developer as the main components and prepared by further incorporating therein the binder described above and, if necessary and desired, waxes, sensitivity improving agents, metal soap, waterproofing agents, and furthermore the white pigment described above and, coating the resulting mixture onto the support.

The leuco dye used in the present invention is not particularly limited as long as it is usable in ordinary pressure-sensitive recording paper, thermosensitive recording paper, etc. Specific examples include: (1) triarylmethane compounds such as 3,3-bis(p-dimethylaminophenyl)-6-dimethylaminophthalide (Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethyl-indol-3-yl)-5-dimethylaminophthalide, 3,3-bis(1,2-dimethylindol-3-yl)-6-di 3,3-bis(9-ethylcarbazol-3-yl)-3,3-bis(2-phenylindol-3-yl)-5-dimethylaminophthalide, 3-p-dimethylaminophenyl-3-(1-methyl-pyrrol-2-yl)-6-dimethylaminophthalide, etc.; (2) diphenylmethane compounds such as 4,4'-bis-dimethylaminobenzhydryl benzyl ether, N-halophenyl leuco Auramine, N-2,4,5-trichlorophenyl leuco Auramine, etc.; (3) xanthene compounds such as Rhodamine B anilinolactam, Rhodamine B p-nitroanilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-diethylamino-7-(3,4-dichloroanilino)fluorane, 3-diethylamino-7-(2-chloroanilino)fluorane, 3-diethylamino-6-methyl-7-anilinofluorane, 3-piperidino-6-methyl-7-anilino-fluorane 3-ethyl-tolylamino-6-methyl-7-anilinofluorane 3-ethyl-tolylamino-6-methyl-7-phenethylfluorane, 3-diethylamino-7-(4-nitroanilino)fluorane, etc.; (4) thiazine compounds such as benzoyl leuco methylene blue, p-nitrobenzoyl leuco methylene blue, etc.; (5) spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)spiropyran, 3-propyl-spiro-dibenzopyran, etc.; or mixtures thereof. They are chosen depending upon the purpose of use and the desired properties.

Specific examples of the color developer used in the present invention include methyl 4-hydroxybenzoate, 4-hydroxyacetophenol, 4-tert-octylcatechol, 2,2'-dihydroxydiphenol, 2,2'-methylenebis(4-methyl-6-tert-butylphenol), 4,4'-isopropylidene-bis(2-tert-butylphenol), 4,4'-secbutylidenediphenol, 4-phenylphenol, 4,4'-isopropylidenediphenol, 2,2'-methylenebis(4-chlorophenol), hydroxy- and 4,4'-cyclohexylidenediphenol, etc.

As waxes, mention may be made of paraffin wax, carnauba wax, microcrystalline wax, polyethylene wax and, in addition thereto, higher fatty acid amides, for example, stearic amide, ethylenebisstearoamide, higher fatty acid esters, etc.

As metal soap, mention may be made of higher fatty acid polyvalent metal salts, i.e., zinc stearate, aluminum stearate, calcium stearate, zinc oleate, etc.

The sensitivity improving agents are those having a sharp melting point between 80° C. and 140° C. and having good thermal response. Specific examples are esters of benzoic acid or terephthalic acid, naphthalenesulfonic acid esters, naphthyl ether derivatives, anthryl ether derivatives, aliphatic ethers and other sensitizers such as phenanthrene, fluorene, etc. Said waxes can also be used as sensitizers.

By providing the intermediate layer containing the colloidal silica and/or colloidal alumina between the support and the thermosensitive color forming layer, thermosensitive recording materials having high color sensitivity and having minimized foreign matters adhered to head can thus be obtained.

EXAMPLES

Next, the preferred embodiments and excellent effects of the present invention will be described by referring to the most typical examples, wherein parts are all by weight.

Example 1

Intermediate layer:

To 500 parts of 20% solution of colloidal silica (manufactured by Nissan Chemical Industries, Ltd.: SNOWTEX 20, particles diameter of 10–20 millimicrons) was added 50 parts of 10% aqueous solution of oxidized starch (manufactured by Nippon Food Processing Co., Ltd., MS-3800) to make a coating liquid. The coating liquid was coated onto a wood free paper weighing 40 g/m$^2$ in a coverage of 1.0 g/m$^2$ (dry solid weight) using an air knife coater and dried to provide an intermediate layer.

Thermosensitive coating liquid:

| | |
|---|---|
| Dispersion A | |
| 3-Diethylamino-6-methyl-7-anilinofluorane | 100 parts |
| 5% Hydroxyethyl cellulose aqueous solution | 500 parts |
| Dispersion B | |
| 4,4'-Isopropylidenediphenol | 100 parts |
| 5% Hydroxyethyl cellulose aqueous solution | 500 parts |
| Dispersion C | |
| 2-Benzyloxynaphthalene | 100 parts |
| 5% Hydroxyethyl cellulose aqueous solution | 500 parts |
| Dispersion D | |

-continued

| | |
|---|---|
| Calcium carbonate | 100 parts |
| 5% Hydroxyethyl cellulose aqueous solution | 500 parts |

Dispersions A, B, C and D were independently dispersed for 6 hours with a sand mill and mixed in a weight ratio of A:B:C:D=1:5:3:2 to make a thermosensitive coating liquid. The thermosensitive coating liquid was coated onto the wood free paper having provided thereon the intermediate layer described above in a coverage of 5 g/m$^2$ (dry solid weight) using an air knife coater. After drying at 60° C., finishing was performed with a supercalender to have Bekk smoothness of 300 to 500 seconds. Thus, a thermosensitive recording sheet was prepared.

This thermosensitive sheet was applied to a thermosensitive printing laboratory equipment with a thin layer head manufactured by Matsushita Electronic Parts Industries, Ltd. Printing was performed under conditions of a head voltage of 0.45 W/dot, 1 line recording time of 30 ms/l and a scanning liner density of 8×3.85 dots/mm, with a pulse width of 0.8, 1.0, 1.1, 1.2, 1.3, 1.4, 1.5 and 2.0 msec, respectively. Its printing density was measured with a Macbeth densitometer to determine color sensitivity and color density; foreign matters adhered to the thermal head were visually observed and evaluated by symbols of ○, ⊘ and ×. wherein symbol○. . . foreign matters were scarcely observed;
symbol⊘. . . foreign matters were less; and,
symbol × . . . foreign matters were observed a lot.

These results are shown in Table-1.

Example 2

With 60 parts of water were mixed 10 parts of 5% sodium pyrophosphate aqueous solution. After 50 parts of calcined kaolin (manufactured by Engelhard, ANSILEX, oil absorption of 75 ml/100 g) were added to and dispersed in the mixture, 250 parts of 20% colloidal silica (SNOWTEX 20) solution, 100 parts of 10% oxidized starch (MS-3800) aqueous solution and 20.8 parts of 48% carboxylated styrene butadiene copolymer latex (manufactured by Asahi Chemical Industry Co., Ltd., DL-620) were added to the dispersion to make a coating liquid.

The coating liquid was coated onto a wood free paper weighing 40 g/m$^2$ in a coverage of 5 g/m$^2$ (dry solid weight) using an air knife coater to provide an intermediate layer; the others (thermosensitive color forming layer, etc.) were identical with Example 1 to prepare a thermosensitive sheet. Measurement was performed with the thermosensitive sheet in a manner similar to Example 1.

Example 3

With 120 parts of water were mixed 10 parts of 5% sodium pyrophosphate aqueous solution. After 95 parts of calcined kaolin (ANSILEX) were added to and dispersed in the mixture, 25 parts of 20% colloidal silica (SNOWTEX 20) solution, 100 parts of 10% oxidized starch (MS-3800) aqueous solution and 20.8 parts of 48% carboxylated styrene butadiene copolymer latex (DL-620) were added to the dispersion to make a coating liquid. The coating liquid was coated onto a wood free paper weighing 40 g/m$^2$ in a coverage of 10 g/m$^2$ (dry solid weight) using an air knife coater to provide an intermediate layer; the others (thermosensitive color forming layer, etc.) were identical with Example 1 to prepare a thermosensitive sheet. Measurement was performed with the thermosensitive sheet in a manner similar to Example 1.

Example 4

A thermosensitive recording sheet was prepared in a manner similar to Example 1 except that the same amount of 20% colloidal alumina (manufactured by Nissan Chemical Industries, Ltd.: AlUMINA SOL 520) solution was substituted for 20% colloidal silica (SNOWTEX 20) solution of Example 1. Measurement was performed with the thermosensitive sheet in a manner similar to Example 1.

Example 5

A thermosensitive recording sheet was prepared in a manner similar to Example 3 except that the same amount of 20% colloidal alumina (AlUMINA SOL 520) solution was substituted for 20% colloidal silica (SNOWTEX 20) solution of Example 3. Measurement was performed with the thermosensitive sheet in a manner similar to Example 1.

Example 6

A thermosensitive recording sheet was prepared in a manner similar to Example 2 except that 125 parts of 20% colloidal silica (SNOWTEX 20) solution and 125 parts of 20% colloidal alumina (AlUMINA SOL 520) solution were substituted for 20% colloidal silica (SNOWTEX 20) solution of Example 2. Measurement was performed with the thermosensitive sheet in a manner similar to Example 1.

Example 7

With 150 parts of water were mixed 10 parts of 5% sodium pyrophosphate aqueous solution. After 95 parts of calcined kaolin (ANSILEX) were added to and dispersed in the mixture, 15 parts of 20% colloidal silica (SNOWTEX 20) solution was added to the dispersion. Then, the same amounts of oxidized starch (MS-3800) and carboxylated styrene butadiene copolymer latex (DL-620) were added to the mixture in this order to make a coating liquid. The coating liquid was treated in a manner similar to Example 3 to prepare a thermosensitive sheet and to be measured.

Comparative Example 1

With 150 parts of water were mixed 10 parts of 5% sodium pyrophosphate aqueous solution. After 100 parts of calcined kaolin (ANSILEX) were added to and dispersed in the mixture, 100 parts of 10% oxidized starch (MS-3800) and 20.8 parts of 48% carboxylated styrene butadiene copolymer latex (DL-620) were added to the mixture in this order to make a coating liquid. The coating liquid was treated in a manner similar to Example 3 to provide an intermediate layer and prepare a thermosensitive sheet. Measurement was performed with the thermosensitive sheet in a manner similar to Example 1.

These results are shown in Table 1.

TABLE 1

| | Color Forming Sensitivity (pulse width, msec) | | | | | | | | Foreign Matters |
|---|---|---|---|---|---|---|---|---|---|
| | 0.8 | 1.0 | 1.1 | 1.2 | 1.3 | 1.4 | 1.5 | 2.0 | on Head |
| Example 1 | 0.54 | 0.73 | 0.86 | 0.99 | 1.15 | 1.20 | 1.27 | 1.35 | ○ |
| 2 | 0.53 | 0.69 | 0.88 | 1.00 | 1.16 | 1.21 | 1.28 | 1.33 | ○ |
| 3 | 0.50 | 0.66 | 0.83 | 0.98 | 1.14 | 1.21 | 1.25 | 1.34 | ◐ |
| 4 | 0.51 | 0.70 | 0.84 | 0.99 | 1.15 | 1.22 | 1.27 | 1.34 | ○ |
| 5 | 0.50 | 0.65 | 0.81 | 0.97 | 1.14 | 1.21 | 1.25 | 1.35 | ◐ |
| 6 | 0.53 | 0.68 | 0.84 | 1.01 | 1.15 | 1.22 | 1.24 | 1.35 | ○ |
| 7 | 0.47 | 0.60 | 0.77 | 0.91 | 1.10 | 1.17 | 1.21 | 1.32 | ◐ |
| Comparative Example 1 | 0.43 | 0.58 | 0.71 | 0.89 | 1.05 | 1.15 | 1.20 | 1.30 | x |

To determine Color sensitivity, a thermosensitive printing laboratory equipment with a thin layer head manufactured by Matsushita Electronic Parts Industries, Ltd. was used and printing was performed under conditions of a head voltage of 0.45 W/dot, 1 line recording time of 30 ms/l and a scanning liner density of $8\times3.85$ dots/mm, with a pulse width of 0.8, 1.0, 1.1, 1.2, 1.3, 1.4, 1.5 and 2.0 msec, respectively. The printing density was measured with a Macbeth densitometer to determine color sensitivity and color density; foreign matters adhered to the thermal head were visually observed. As is evident from the results of the examples, excellent thermosensitive recording materials with high color sensitivity could be obtained substantially almost without generating foreign matters adhered to head, by providing the intermediate layer containing colloidal silica and/or colloidal alumina between the support and the thermosensitive color forming layer.

While the invention has been described in detail and with reference to specific embodiments thereof, it will be apparent to on skilled in the art that various changes and modifications can be made therein without departing from the spirit and scope thereof.

What is claimed is:

1. A thermosensitive recording material comprising a support having provided thereon a thermosensitive color forming layer comprising a substantially colorless or light-colored electron donative leuco dye and an electron accepting color developer which reacts with said electron donative leuco dye to form a color, and having further provided between said support and said thermosensitive color forming layer an intermediate layer comprising a binder and at least one of colloidal silica and colloidal alumina as the main component.

2. A thermosensitive recording material of claim 1, wherein a coating amount of said intermediate layer is in a range of 1 to 15 g/m$^2$.

3. A thermosensitive recording material of claim 1, wherein said intermediate layer further comprises a white pigment.

4. A thermosensitive recording material of claim 3, wherein the weight ratio of the colloidal silica and colloidal alumina to the white pigment is 100:0 to 5:95.

* * * * *